US006360508B1

(12) United States Patent
Pelfrey et al.

(10) Patent No.: US 6,360,508 B1
(45) Date of Patent: Mar. 26, 2002

(54) UNIVERSAL ACCENT CHANNEL

(75) Inventors: Paul Pelfrey, Pickerington; Philip Stobart, Worthington, both of OH (US)

(73) Assignee: Crane Plastics Siding LLC, Columbus, OH (US)

( * ) Notice: Subject to any disclaimer, the term of this patent is extended or adjusted under 35 U.S.C. 154(b) by 0 days.

(21) Appl. No.: 09/521,066

(22) Filed: Mar. 8, 2000

(51) Int. Cl.[7] ..... E04D 1/00

(52) U.S. Cl. ..... 52/520; 52/537; 52/539; 52/545; 52/552; 52/198

(58) Field of Search ..... 52/520, 537, 539, 52/545, 552, 198, 730.6, 731.5, 731.7, 733.2

(56) References Cited

U.S. PATENT DOCUMENTS

| | | | | | |
|---|---|---|---|---|---|
| 3,387,418 | A | * | 6/1968 | Tyrer | 52/730.6 |
| 4,001,997 | A | | 1/1977 | Saltzman | 52/521 |
| 4,189,885 | A | | 2/1980 | Fritz | 52/287 |
| 4,319,439 | A | | 3/1982 | Gussow | 52/288 |
| 4,389,824 | A | | 6/1983 | Anderson | 52/211 |
| 4,608,800 | A | | 9/1986 | Fredette | 52/656 |
| 4,843,790 | A | | 7/1989 | Taravella | 52/211 |
| 4,920,709 | A | | 5/1990 | Garries et al. | 52/85 |
| 4,998,947 | A | | 3/1991 | Dostall et al. | 52/300 |
| 5,022,204 | A | | 6/1991 | Anderson | 52/211 |
| 5,090,174 | A | | 2/1992 | Fragale | 52/309.9 |
| 5,103,612 | A | | 4/1992 | Wright | 52/288 |
| 5,282,344 | A | | 2/1994 | Moore | 52/716.8 |
| 5,392,574 | A | | 2/1995 | Sayers | 52/217 |
| 5,461,839 | A | * | 10/1995 | Beck | 52/519 |
| 5,533,308 | A | | 7/1996 | Fullwood | 52/204.5 |
| 5,560,170 | A | | 10/1996 | Ganser et al. | 52/539 |
| 5,581,970 | A | | 12/1996 | O'Shea | 52/718.01 |
| 5,586,415 | A | | 12/1996 | Fisher et al. | 52/58 |
| 5,660,010 | A | | 8/1997 | Sayers | 52/217 |
| 5,675,955 | A | | 10/1997 | Champagne | 52/521 |
| 5,678,367 | A | | 10/1997 | Kline | 52/211 |
| 5,694,728 | A | | 12/1997 | Heath, Jr. et al. | 52/554 |
| 5,720,114 | A | | 2/1998 | Guerin | 33/451 |
| 5,765,333 | A | | 6/1998 | Cunningham | 52/481.1 |
| 5,791,093 | A | * | 8/1998 | Diamond | 52/36.5 |
| 5,829,206 | A | | 11/1998 | Bachman | 52/94 |

* cited by examiner

*Primary Examiner*—Carl D. Friedman
*Assistant Examiner*—Chi Nguyen
(74) *Attorney, Agent, or Firm*—Standley & Gilcrest LLP

(57) ABSTRACT

An elongated accent channel for siding construction includes a rear leg, a transverse leg, and a front leg. The transverse leg extends outwardly from the rear leg and has a first flat portion and a substantially u-shaped portion. The first flat portion is at the first end of the transverse leg, and the first end of the transverse leg is connected to the rear leg. The front leg extends outwardly from the transverse leg, and the first end of the front leg is connected to the second end of the transverse leg. The front leg is spaced apart from the rear leg and defines an accent channel opening therebetween to retain an edge portion of a piece of siding. A corner post assembly including the elongated accent channel and a corner post and a method of applying siding to a wall are also disclosed.

22 Claims, 4 Drawing Sheets

UNIVERSAL ACCENT CHANNEL

BACKGROUND OF THE INVENTION

This invention relates generally to trim components for use in siding construction, and more particularly, to an accent channel which can be used with corner posts and around windows and doors.

Trim components are needed to install siding on a structure and to provide a finished look for the siding. Many different types of trim components are used, including inside and outside corners, starter strips, drip caps, J-channels, L-channels, and finish trim.

Typically for outside corners, a corner post is attached to the structure, and the siding is then mounted on the structure with ends of the siding being covered by the corner post. Similarly, trim must be mounted around doors and windows to cover the ends of the siding at those locations.

It would be advantageous to be able to use the same type of trim piece around doors and windows as well as at corners, since this would reduce the number of different types of trim components needed.

DESCRIPTION OF THE INVENTION

Figure 1:
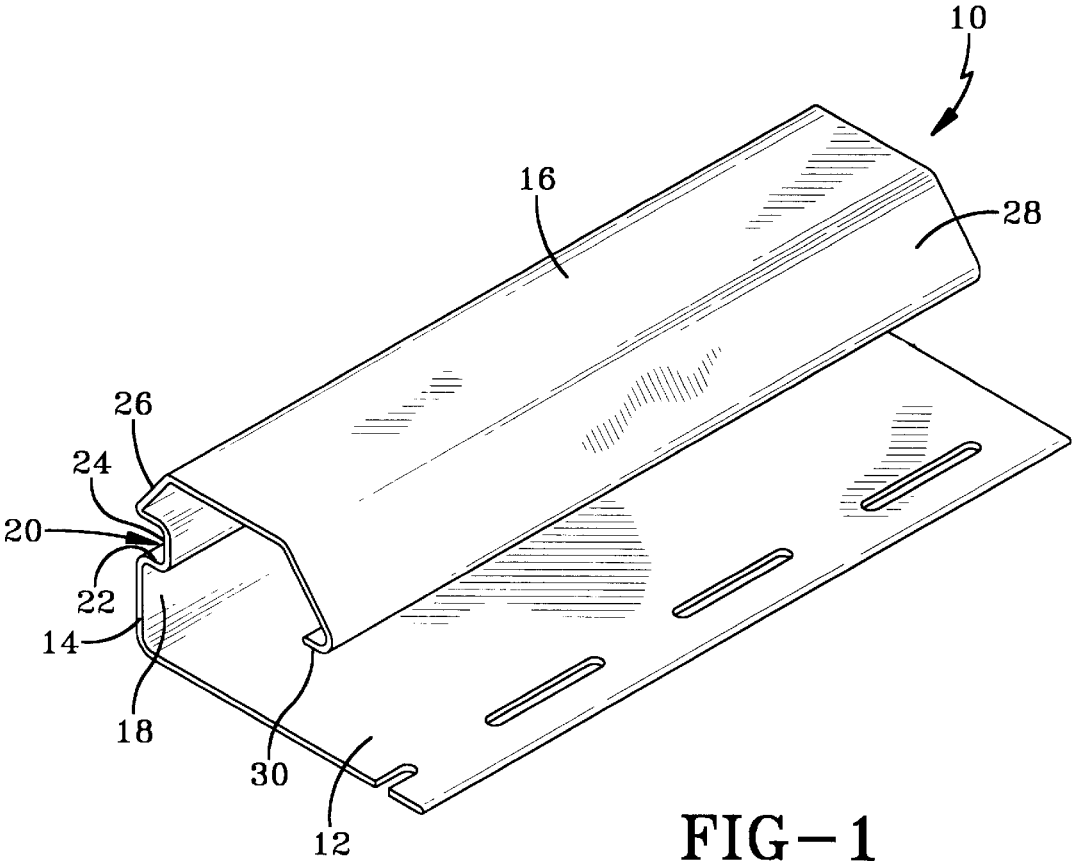
FIG. 1 shows a perspective view of a preferred embodiment of the accent channel of the present invention.
Figure 2:
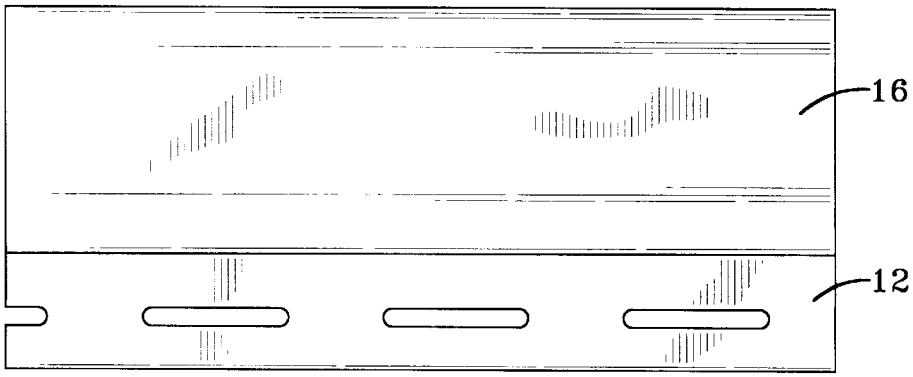
FIG. 2 is a top plan view of the channel of FIG. 1.
Figure 3:
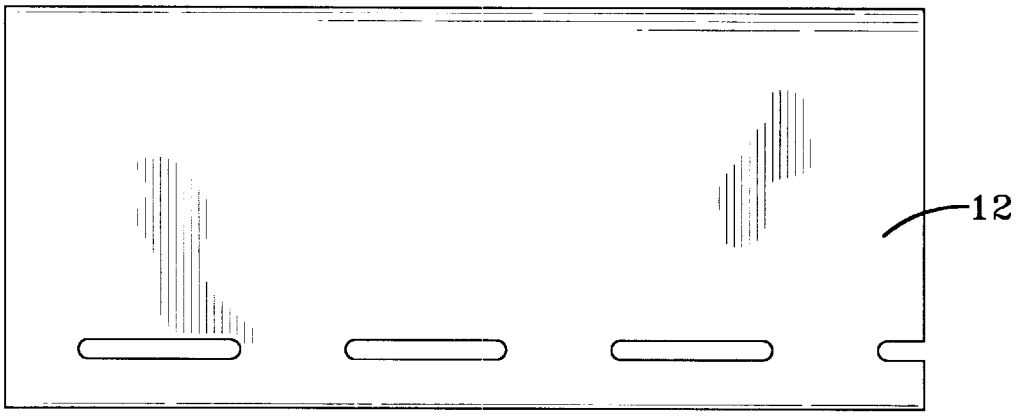
FIG. 3 is a bottom plan view of the channel of FIG. 1.
Figure 4:
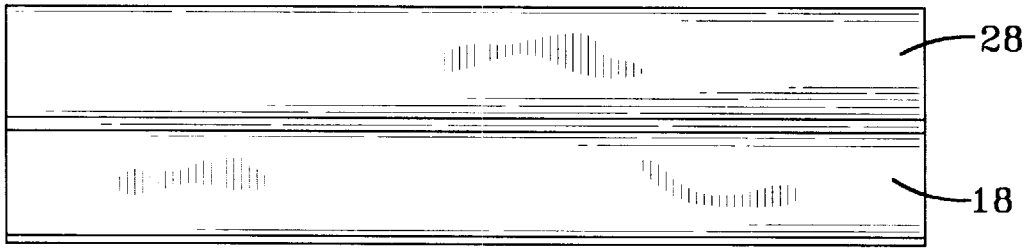
FIG. 4 is a front side elevation view of the channel of FIG. 1.
Figure 5:
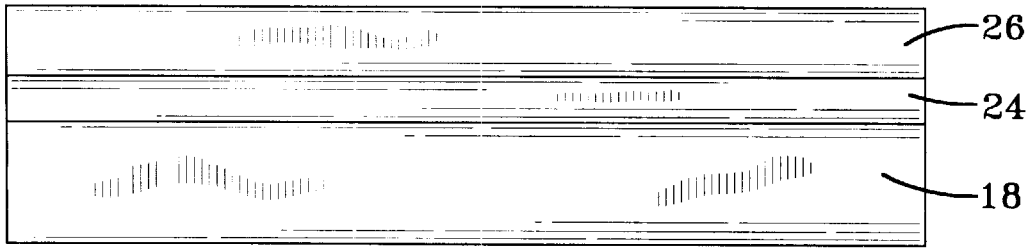
FIG. 5 is a back side elevation view of the channel of FIG. 1.

The elongated accent channel for siding construction of the present invention is a universal accent channel which can be used with corner posts as well as around windows and doors. It includes a rear leg, a transverse leg, and a front leg. The transverse leg extends outwardly from the rear leg and has a first flat portion and a substantially u-shaped portion. The first flat portion is at the first end of the transverse leg, which is connected to the rear leg. The front leg extends outwardly from the transverse leg, and the first end of the front leg is connected to the second end of the transverse leg. The front leg is spaced apart from the rear leg and defines an accent channel opening therebetween to retain an edge portion of a piece of siding.

The front leg is preferably substantially parallel to the rear leg, and the transverse leg is preferably substantially perpendicular to the rear leg and the front leg. The rear leg is preferably longer than the front leg and has openings through which the elongated accent channel can be secured to a wall.

The second end of the first flat portion of the transverse leg is preferably connected to the first side of the substantially u-shaped portion of the transverse leg, and the first end of the front leg is connected to the second side of the substantially unshaped portion of the transverse leg.

The rear leg, the transverse leg, and the front leg are preferably integral. The elongated accent channel can include a hook flange connected to the second end of the front leg.

The elongated accent channel preferably includes a first additional leg. The first end of the first additional leg is connected to the second end of the transverse leg, and the second end of the first additional leg is connected to the first end of the front leg. The elongated accent channel preferably also includes a second additional leg. The first end of the second additional leg is connected to the second end of the front leg, and there is preferably a hook flange connected to the second end of the second additional leg. The front leg is preferably substantially parallel to the rear leg.

The elongated accent channel could include a second additional leg without a first additional leg. In this case, the first end of the front leg is connected to the second end of the transverse leg, and the second end of the front leg is connected to the first end of the second additional leg.

The transverse leg could include a second flat portion. In this arrangement, the second end of the first flat portion of the transverse leg is connected to the first side of the substantially u-shaped portion of the transverse leg, and the first end of the second flat portion of the transverse leg is connected to the second side of the substantially u-shaped portion of the transverse leg. The first end of the front leg is connected to the second end of the second flat portion of the transverse leg. Alternatively, if there is a first additional leg, it is connected to the second end of the second flat portion of the transverse leg.

A corner post trim assembly is also disclosed. It includes one or more elongated accent channels as described above and a corner post. The corner post includes a first rear portion, a first transverse portion, and a first flange. The first transverse portion extends outwardly from the first rear portion, and one end of the first transverse portion is connected to the first rear portion. The first flange extends outwardly from the first transverse portion and is connected to the second end of the first transverse portion. The first flange is spaced apart from the first rear portion and defines a first corner post opening therebetween. The first flange is adapted to fit in the substantially u-shaped portion of the transverse leg of the elongated accent channel, and the first flat portion of the transverse leg of the elongated accent channel is adapted to fit in the first corner post opening.

The corner post also includes a second rear portion, a second transverse portion, and a second flange. The second rear portion is spaced apart from the first rear portion and is substantially perpendicular thereto. The second transverse portion extends outwardly from the second rear portion, and one end of the second transverse portion is connected to the second rear portion. The second flange extends outwardly from the second transverse portion and is connected to the second end of the second transverse portion. The second flange is spaced apart from the second rear portion and defines a second corner post opening therebetween. The second flange is adapted to fit in the substantially unshaped portion of the transverse leg of the elongated accent channel, and the first flat portion of the transverse leg of the elongated accent channel is adapted to fit in the second corner post opening.

The corner post also has a first front portion and a second front portion. The first end of the first front portion is connected to the first flange, and the first end of the second front portion is connected to the second flange. The second end of the second front portion is connected to the second end of the first front portion, and the first and second front portions are substantially perpendicular.

The first transverse portion is preferably substantially perpendicular to the first rear portion and the first front portion. The first flange and the first front portion are preferably substantially parallel to the first rear portion. The second transverse portion is preferably substantially perpendicular to the second rear portion and the second flange. The second front portion is preferably substantially parallel to the second rear portion.

The first flange preferably has an inner portion and outer portion, which are substantially parallel. The inner portion is connected to the second end of the first transverse portion, and the outer portion is connected to the first end of the first front portion. The second flange preferably also has an inner portion and outer portion which are substantially parallel. The inner portion is connected to the first end of the second transverse portion, and the outer portion is connected to the second end of the second front portion.

A method of applying siding to a wall is also disclosed. The method includes providing the elongated accent channel described above, attaching the elongated accent channel to the wall, positioning an edge of the siding inside the opening in the elongated accent channel, and attaching the siding to the wall. The method preferably includes, prior to attaching the elongated accent channel to the wall, providing a corner post having a first rear portion, a first transverse portion, and a first flange. The first flange extends outwardly from the first transverse portion and is connected to a second end of the first transverse portion. The first flange is spaced apart from the first rear portion and defines a first corner post opening therebetween. The first flange is adapted to fit in the substantially unshaped portion of the transverse leg of the elongated accent channel, and the first flat portion of the transverse leg of the elongated accent channel is adapted to fit in the first corner post opening. The method includes attaching the corner post to the wall, and positioning the elongated accent channel so that the flange of the corner post fits in the substantially unshaped portion of the elongated accent channel.

Figure 6:
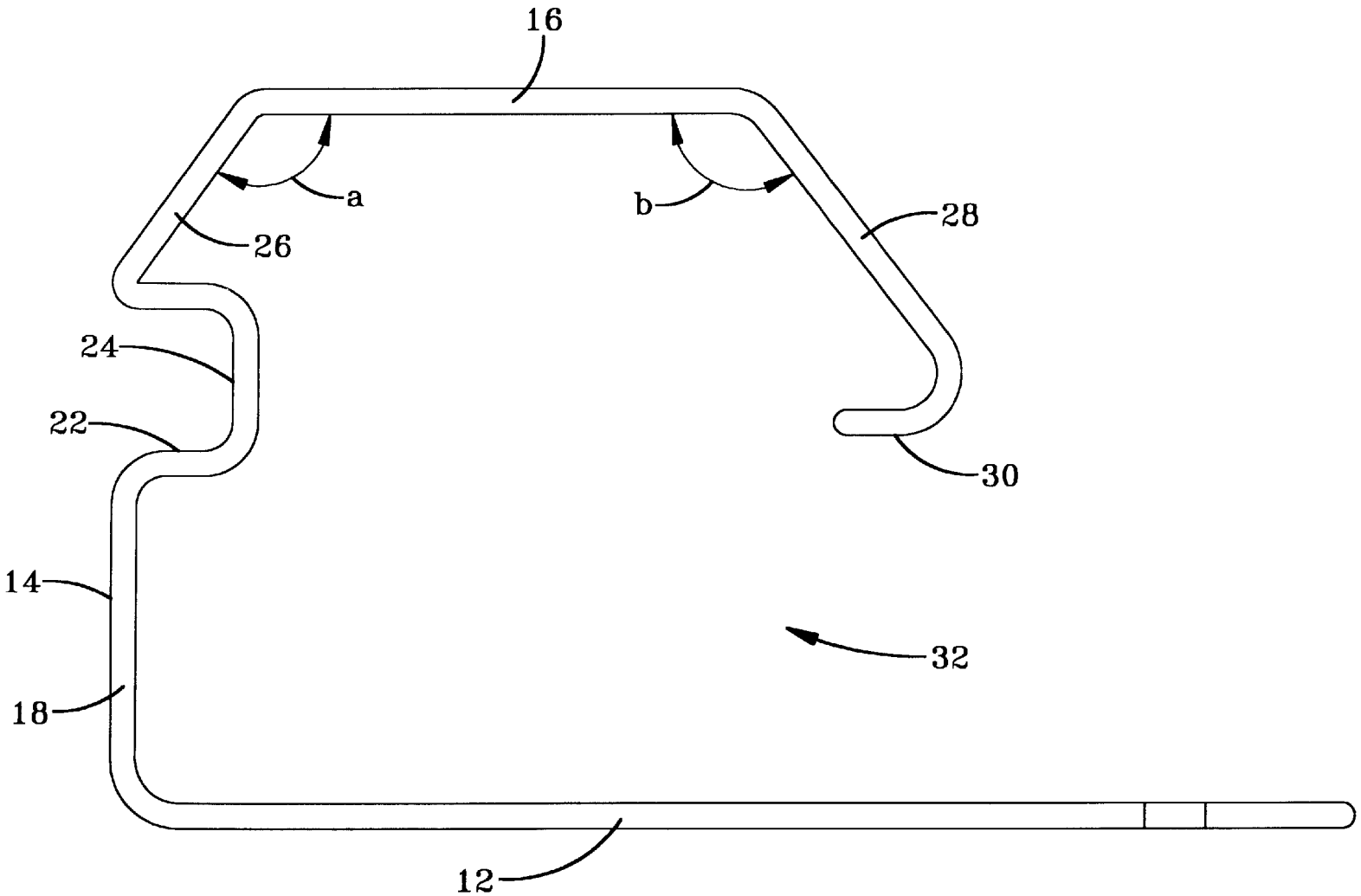
FIG. 6 is a cross-section view of the channel of FIG. 1.

FIG. 1 and FIG. 6 shows the elongated accent channel 10. It has a rear leg 12, a transverse leg 14 and a front leg 16. The transverse leg 14 extends outwardly from the rear leg 12. The transverse leg 14 has a first flat portion 18 and a substantially unshaped portion 20. The first flat portion 18 is at the first end of the transverse leg 14 which is connected to the rear leg 12. The first side 22 of the substantially unshaped portion 20 of the transverse leg 14 is connected to the second end of the first flat portion 18. The second side 24 of the substantially unshaped portion 20 is connected to one end of the first additional leg 26. The other end of the first additional leg 26 is connected to one end of the front leg 16. The angle a between the first additional leg 26 and the front leg 16 is preferably between about 90 and 150 degrees from the plane of the front leg 16. The other end of the front leg 16 is connected to one end of the second additional leg 28. The angle b between the second additional leg 28 and the front leg 16 is preferably between about 90 and 150 degrees from the plane of the front leg 16. The other end of the second additional leg 28 has a hook flange 30 on it. The hook flange 30 preferably extends back toward the transverse leg 14. The space between the hook flange 30 and rear leg 12 defines an accent channel opening 32. The ends of the siding fit into the accent channel opening 32.

The transverse leg 14 is substantially perpendicular to the rear leg 12 and the front leg 16, although it could be at a different angle if desired. The front leg 16 is substantially parallel to the rear leg 12, although it could be at an angle if desired.

The rear leg 12 preferably is longer than the front leg 16, and it has openings through which nails, staples, or the like can be placed so that the elongated accent channel 10 can be easily attached to the structure.

In another embodiment, the first additional leg 26 is connected to one end of a second flat portion of the transverse leg 14. The other end of the second flat portion is connected to the second leg 24 of the substantially unshaped portion 20 of the transverse leg 14.

In another embodiment, where there is no first additional leg, the front leg 16 is directly connected to the transverse leg 14. Alternatively, if there is no first additional leg and the transverse leg has a second flat portion, the front leg 16 may be directly connected to the second fiat portion of the transverse leg 14.

If there is no second additional leg, the hook flange 30 may be directly connected to the second end of the front leg 16.

One advantage of the elongated accent channel of the present invention is that it can be used with siding which is thicker than typical siding. Siding which has insulation on the back is thicker. The elongated accent channel can accommodate this increased thickness.

Figure 7:
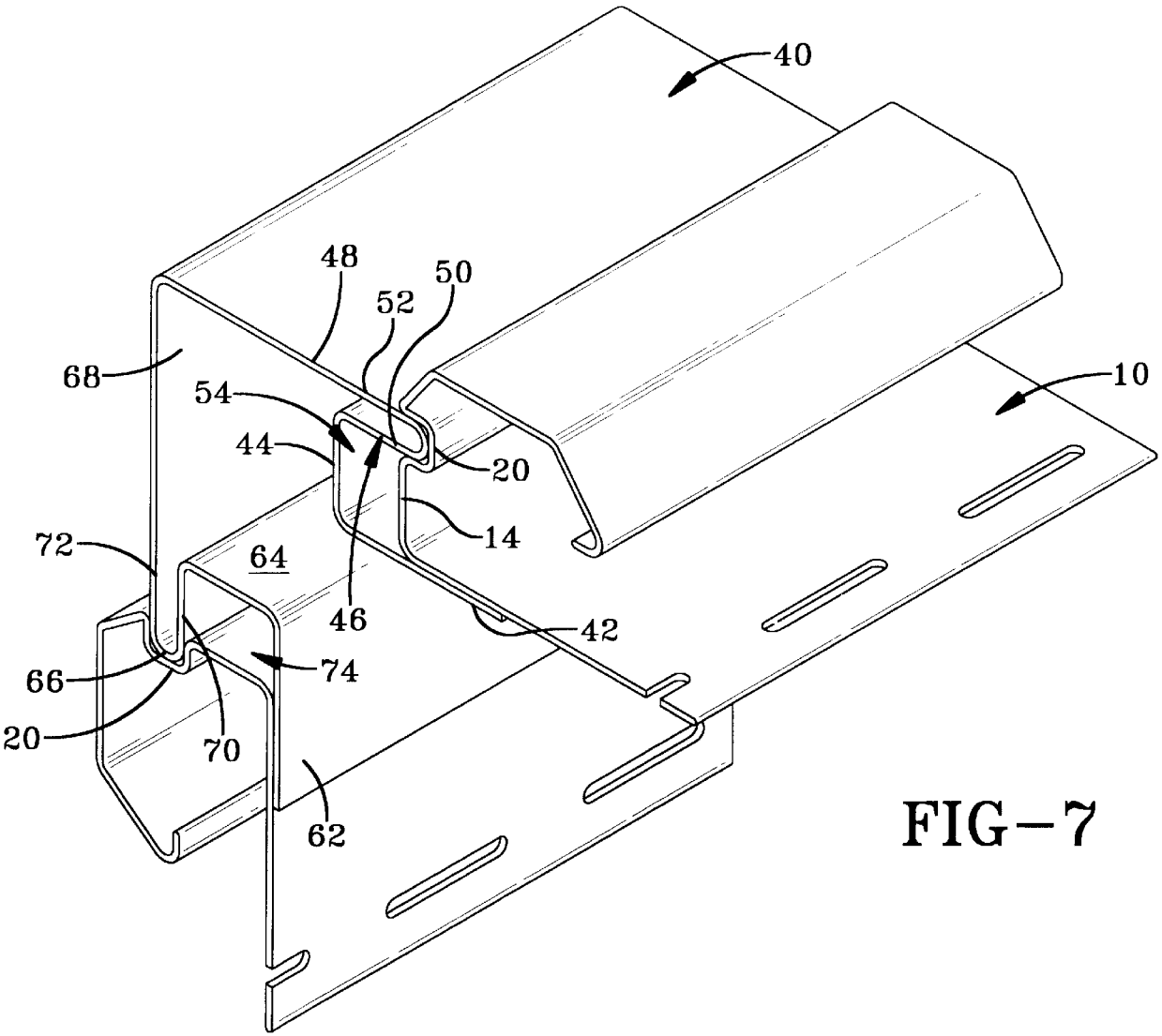
FIG. 7 is a perspective view of a corner member and two accent channels assembled together in another embodiment of the present invention.

As shown in FIG. 7, the corner post trim assembly includes an elongated accent channel 10 and a corner post 40. The corner post 40 has a first rear portion 42 and a first transverse portion 44, which extends outwardly from the first rear portion 42. A first flange 46 extends outwardly from the first transverse portion 44. The first flange 46 is connected to a first front portion 48. The first flange 46 has an inner portion 50 and an outer portion 52 which are substantially parallel to one another. The inner portion 50 of the first flange 46 is connected to the first transverse portion 44. The outer portion 52 is connected to, and is in the same plane as, the first front portion 48. However, the outer portion of the first flange could be offset from the plane of the first front portion if desired. The first flange 46 is spaced apart from the first rear portion 42, and the space between the first flange 46 and the first rear portion 42 defines a first corner post opening 54. The first flange 46 fits into the substantially unshaped portion 20 of the transverse leg 14 of the elongated accent channel 10, and the first flat portion 18 of the transverse leg 14 fits into the first corner post opening 54.

The first transverse portion 44 is preferably substantially perpendicular to the first rear portion 42 and the first flange 46, although they can be at different angles if desired. The first flange 46 and the first front portion 48 are preferably substantially parallel to the first rear portion 42, although they can be at an angle if desired.

The corner post 40 also has a second rear portion 62 which is spaced apart from the first rear portion 42 and is substantially perpendicular to it. A second transverse portion 64 extends outwardly from the second rear portion 62. A second flange 66 extends outwardly from the second transverse portion 64. The second flange 66 is connected to a second front portion 68. The second end of the first front portion 48 is connected to the second end of the second front portion 68, and the first and second front portions are substantially perpendicular. The second flange 66 has an inner portion 70 and an outer portion 72 which are substantially parallel to one another. The inner portion 70 of the second flange 66 is connected to the second transverse portion 64. The outer portion 72 is connected to, and is in the same plane as, the second front portion 68. However, the outer portion of the second flange could be offset from the plane of the second front portion if desired. The second flange 66 is spaced apart from the second rear portion 62, and the space between the second flange 66 and the second rear portion 62 defines a second corner post opening 74. The second flange 66 fits into the substantially u-shaped portion 20 of the first transverse leg 14 of a second elongated accent channel 10, and the first flat portion 18 of the transverse leg 14 fits into the second corner post opening 74.

The second transverse portion 64 is preferably substantially perpendicular to the second rear portion 62 and the second flange 66, although they can be at different angles if desired. The second flange 66 and the second front portion 68 are preferably substantially parallel to the second rear portion 62, although they can be at an angle if desired.

The corner post trim assembly with its combination of the corner post and the elongated accent channels make it appear as though the corner piece is 6 inches wide, rather than just 4 inches. The apparent increased size of the corner post presents a more substantial appearance to the corner.

The corner post is attached to the structure using nails, staples, or the like. The elongated accent channels are positioned next to the corner post so that the flange of the corner post fits in the substantially u-shaped portion of the elongated accent channel and the first flat portion of the transverse leg of the elongated accent channel fits in the corner post opening. The elongated accent channels are attached to the structure. The siding is then aligned and placed so that the edge of the siding is in the accent channel opening, and it is attached to the structure.

The present invention may be extruded using known extrusion techniques. The present invention may be made from plastic, such as PVC or it may be made from a PCV/wood flour blend, or a polyethylene/wood flour blend, also extruded. One embodiment includes a formulation of about 50% wood flour and about 50% polymer compound.

The embodiments herein disclosed are not intended to be exhaustive or to unnecessarily limit the scope of the invention. These embodiments were chosen and described in order to explain the principles of the present invention so that others skilled in the art may practice the invention. Having shown and described several embodiments of the present invention, those skilled in the art will realize that many variations and modifications may be made to affect the described invention. Many of those variations and modifications will provide the same result and fall within the spirit of the claimed invention. The invention is intended to be limited only as indicated by the scope of the claims.

What is claimed is:

1. An elongated accent channel for siding construction comprising:

a rear leg;

a transverse leg extending outwardly from the rear leg, the transverse leg having a first flat portion and a substantially u-shaped portion, the first flat portion being at a first end of the transverse leg, the first end of the transverse leg being connected to the rear leg; and a front leg extending outwardly from the transverse leg, a first end of the front leg being connected to a second end of the transverse leg, wherein the front leg is spaced apart from the rear leg, wherein the rear leg is longer than the front leg, and defines an accent channel opening therebetween to retain an edge portion of a piece of siding.

2. The elongated accent channel of claim 1, further comprising a hook flange connected to a second end of the front leg.

3. The elongated accent channel of claim 1 wherein the front leg is substantially parallel to the rear leg.

4. The elongated accent channel of claim 1 wherein the transverse leg is substantially perpendicular to the rear leg.

5. The elongated accent channel of claim 1 wherein the transverse leg is substantially perpendicular to the front leg.

6. The elongated accent channel of claim 1 wherein the rear leg has openings through which the elongated accent channel can be secured to a wall.

7. The elongated accent channel of claim 1 wherein the rear leg, the transverse leg, and the front leg are integral.

8. The elongated accent channel of claim 1 further comprising a first additional leg, a first end of the first additional leg being connected to a second end of the transverse leg, and a second end of the first additional leg being connected to a first end of the front leg.

9. The elongated accent channel of claim 8 further comprising a second additional leg, a first end of the second additional leg being connected to a second end of the front leg.

10. The elongated accent channel of claim 9, further comprising a hook flange connected to a second end of the second additional leg.

11. The elongated accent channel of claim 1 further comprising a second additional leg, a second end of the front leg being connected to a first end of the second additional leg.

12. The elongated accent channel of claim 1 wherein the transverse leg further comprises a second flat portion, u-second end of the first flat portion of the transverse leg being connected to a first side of the substantially unshaped portion of the transverse leg, and a first end of the second flat portion of the transverse leg being connected to a second side of the substantially unshaped portion of the transverse leg.

13. A corner post trim assembly comprising:

an elongated accent channel comprising:

a rear leg;

a transverse leg extending outwardly from the rear leg, the transverse leg having a first flat portion and a substantially unshaped portion, the first flat portion being at a first end of the transverse leg, the first end of the transverse leg being connected to the rear leg; and a front leg extending outwardly from the transverse leg, a first end of the front leg being connected to a second end of the transverse leg, wherein the front leg is spaced apart from the rear leg and defines an accent channel opening therebetween to retain an edge portion of a piece of siding; and a corner post comprising:

a first rear portion;

a first transverse portion extending outwardly from the first rear portion, a first end of the first transverse portion being connected to the first rear portion; and a first flange extending outwardly from the first transverse portion, the first flange being connected to a second end of the first transverse portion, wherein the first flange is spaced apart from the first rear portion and defines a first corner post opening therebetween, the first flange being adapted to fit in the substantially u-shaped portion of the transverse leg of the elongated accent channel, and the first flat portion of the transverse leg of the elongated accent channel being adapted to fit in the first corner post opening.

14. The corner post trim assembly of claim 13 wherein the corner post further comprises:

a second rear portion spaced apart from the first rear portion and substantially perpendicular thereto;

a second transverse portion extending outwardly from the second rear portion, a first end of the second transverse portion being connected to the second rear portion; and a second flange extending outwardly from the second transverse portion, the second flange being connected to a second end of the second transverse portion, wherein the second flange is spaced apart from the second rear portion and defines a second corner post opening therebetween, the second flange being adapted to fit in the substantially u-shaped portion of the transverse leg of the elongated accent channel, and the first flat portion of the transverse leg of the elongated accent channel being adapted to fit in the second corner post opening.

15. The corner post trim assembly of claim 14 wherein there are two accent channels.

16. The corner post trim assembly of claim 14 wherein the corner post further comprises:

a first front portion, a first end of the first front portion connected to the first flange; and a second front portion, a first end of the second front portion connected to the second flange, a second end of the second front portion connected to a second end of the first front portion, the first front portion and the second front portion being substantially perpendicular.

17. The corner post trim assembly of claim 16 wherein the first flange has an inner portion and outer portion, the inner portion and the outer portion being substantially parallel, the inner portion being connected to the second end of the first transverse portion, and the outer portion being connected to the first end of the first front portion.

18. A method of applying siding to a wall comprising:

providing an elongated accent channel, the elongated accent channel comprising:

a rear leg;

a transverse leg extending outwardly from the rear leg, the transverse leg having a first flat portion and a substantially unshaped portion, the first flat portion being at a first end of the transverse leg, the first end of the transverse leg being connected to the rear leg; and a front leg extending outwardly from the transverse leg, a first end of the front leg being connected to a second end of the transverse leg, wherein the front leg is spaced apart from the rear leg and defines an accent channel opening therebetween to retain an edge of a piece of siding;

attaching the elongated accent channel to the wall;

positioning the edge of the piece of siding inside the accent channel opening; and attaching the siding to the wall.

19. The method of claim 18 further comprising:

prior to attaching the elongated accent channel to the wall, providing a corner post comprising:

a first rear portion;

a first transverse portion extending outwardly from the first rear portion, a first end of the first transverse portion being connected to the first rear portion; and a first flange extending outwardly from the first transverse portion, the first flange being connected to a second end of the first transverse portion, wherein the first flange is spaced apart from the first rear portion and defines a first corner post opening therebetween, the first flange being adapted to fit in the substantially u-shaped portion of the transverse leg of the elongated accent channel, and the first flat portion of the transverse leg of the elongated accent channel being adapted to fit in the first corner post opening;

attaching the corner post to the wall; and positioning the elongated accent channel so that the first flange of the corner post fits in the substantially u-shaped portion of the elongated accent channel and the first flat portion of the transverse leg of the elongated accent channel fits in the first corner post opening.

20. The method of claim 19 wherein the corner post further comprises:

a second rear portion spaced apart from the first rear portion and substantially perpendicular thereto;

a second transverse portion extending outwardly from the second rear portion, a first end of the second transverse portion being connected to the second rear portion;

a second flange extending outwardly from the second transverse portion, the second flange being connected to a second end of the second transverse portion, wherein the second flange is spaced apart from the second rear portion and defines a second opening therebetween to receive the first flat portion of the transverse leg of the elongated accent channel.

21. The method of claim 20 further comprising positioning a second elongated accent channel so that the second flange of the corner post fits in the substantially u-shaped portion of the second elongated accent channel and the first flat portion of the transverse leg of the second elongated accent channel fits in the second corner post opening and attaching the second elongated accent channel to the wall.

22. The elongated accent channel of claim 1, wherein said channel is comprised of a wood polymer composition.

* * * * *

UNITED STATES PATENT AND TRADEMARK OFFICE

CERTIFICATE OF CORRECTION

PATENT NO. : 6,360,508 B1
DATED : March 26, 2002
INVENTOR(S) : Pelfrey et al.

It is certified that error appears in the above-identified patent and that said Letters Patent is hereby corrected as shown below:

Column 1,
Line 63, please delete “unshaped” and replace it with -- u-shaped --.

Column 3,
Lines 29, 35, 41, 44 and 46, please delete each occurrence of “unshaped” and replace them with -- u-shaped --.

Column 4,
Lines 6 and 39, please delete each occurrence of “unshaped” and replace them with -- u-shaped --.

Column 6,
Line 25, please delete “u-second” and replace it with -- a second --.
Lines 26, 28 and 35, please delete each occurrence of “unshaped” and replace them with -- u-shaped --.

Column 7,
Line 37, please delete “unshaped” and replace it with -- u-shaped --.

Signed and Sealed this

Fifteenth Day of October, 2002

*Attest:*

*Attesting Officer*

JAMES E. ROGAN
*Director of the United States Patent and Trademark Office*